United States Patent [19]

Killman et al.

[11] Patent Number: 4,523,745

[45] Date of Patent: Jun. 18, 1985

[54] PROTECTOR FOR LAZY-TONG FENCE

[76] Inventors: David L. Killman, Loraine C. Killman, both of 10685 Colorado Rd., Atascadero, Calif. 93422

[21] Appl. No.: 461,558

[22] Filed: Jan. 27, 1983

[51] Int. Cl.[3] ..... E04H 17/00

[52] U.S. Cl. ..... 256/1; 160/161; 5/424

[58] Field of Search ..... 256/1, 25, 26; 160/161, 160/136; 248/345.1; 5/424, 425

[56] References Cited

U.S. PATENT DOCUMENTS

| | | | |
|---|---|---|---|
| 1,215,462 | 2/1917 | Agee | 160/136 |
| 2,756,790 | 7/1956 | Synbad | 145/35 D |
| 3,219,079 | 11/1965 | Stambol | 145/35 D |
| 3,523,710 | 8/1970 | Barecki et al. | 248/345.1 X |
| 3,742,530 | 7/1973 | Clark | 5/245 |
| 4,089,497 | 5/1978 | Miller | 248/345.1 |

FOREIGN PATENT DOCUMENTS

| | | | |
|---|---|---|---|
| 830747 | 3/1960 | United Kingdom | 145/35 D |

*Primary Examiner*—Andrew V. Kundrat

*Attorney, Agent, or Firm*—Daniel C. McKown

[57] ABSTRACT

An article for protecting a child from accidental injurious contact with the upwardly pointing vertices of a lazy-tong fence includes, in a first embodiment, a pocket-shaped shell that fits over a vertex of the fence and is secured in that position by a strap. In a second embodiment the protective article includes an elongated pad that is draped over several of the vertices of the fence and secured in that position. In a third embodiment restricted to planar fences, the protective article includes an extrusion that clamps onto the fence.

12 Claims, 17 Drawing Figures

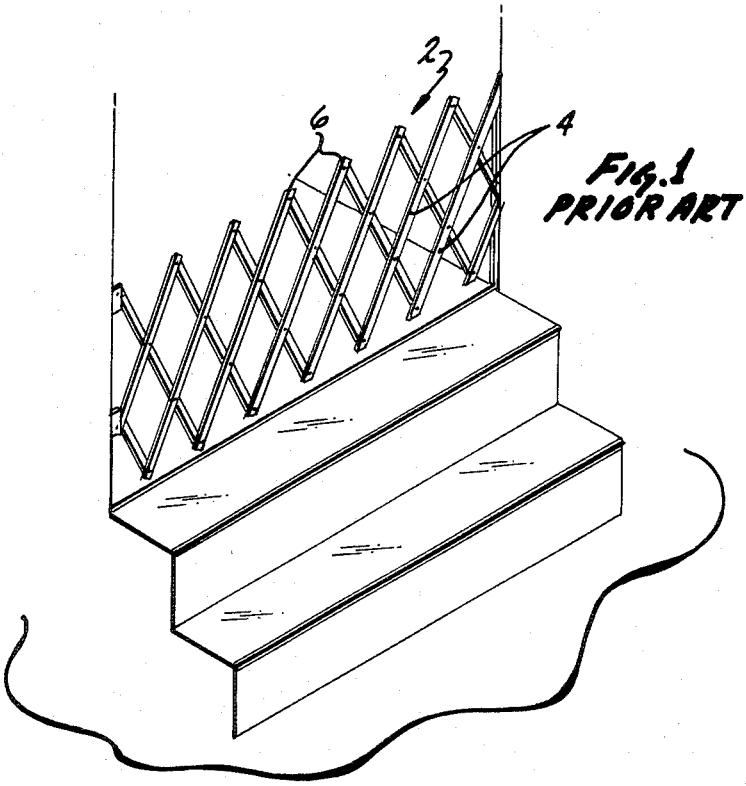
FIG. 1
PRIOR ART
FIG. 15
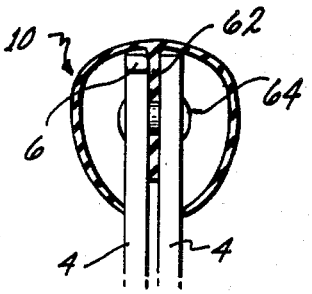
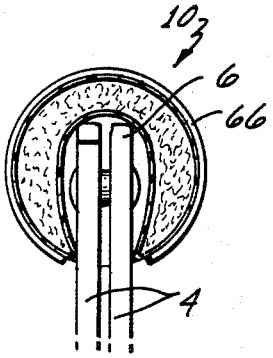
FIG. 16
FIG. 2
PRIOR ART
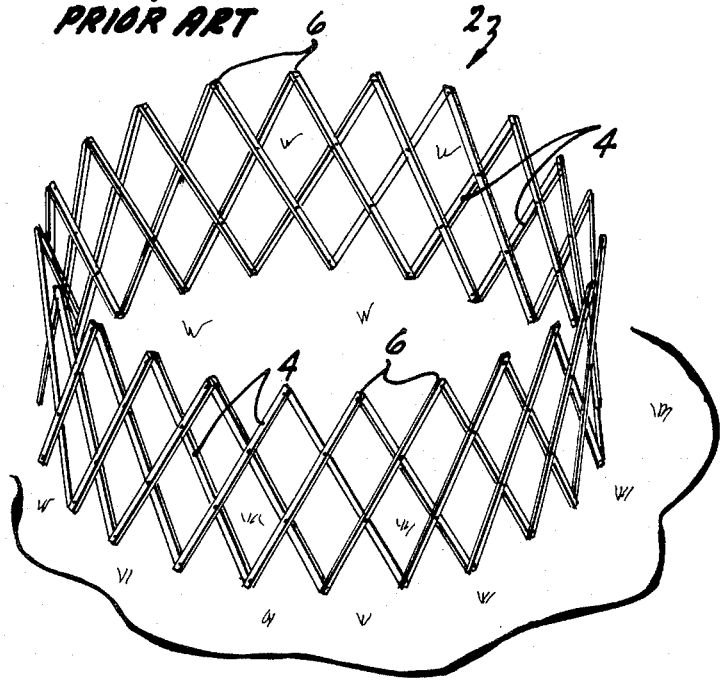
FIG. 17
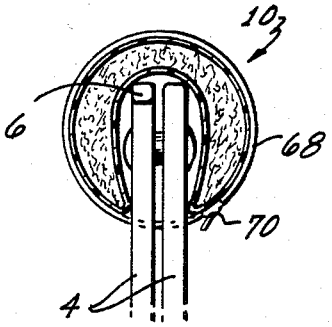

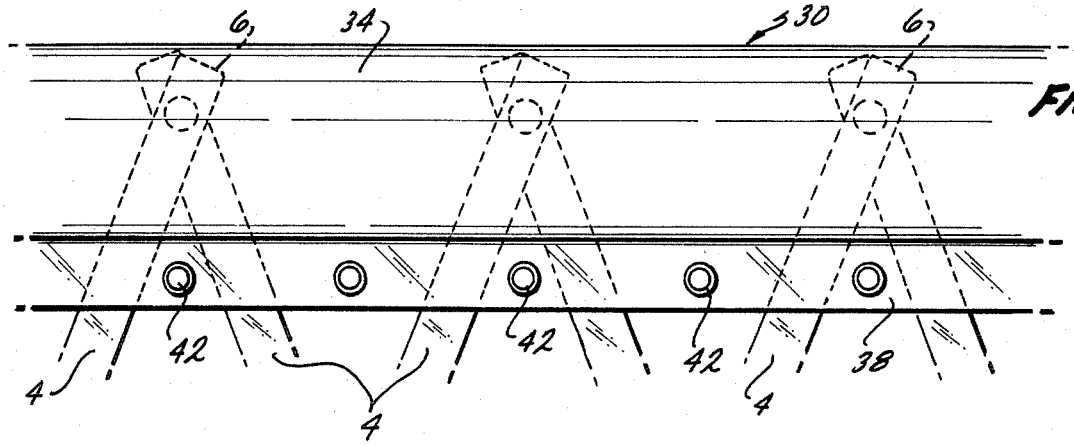
FIG. 9
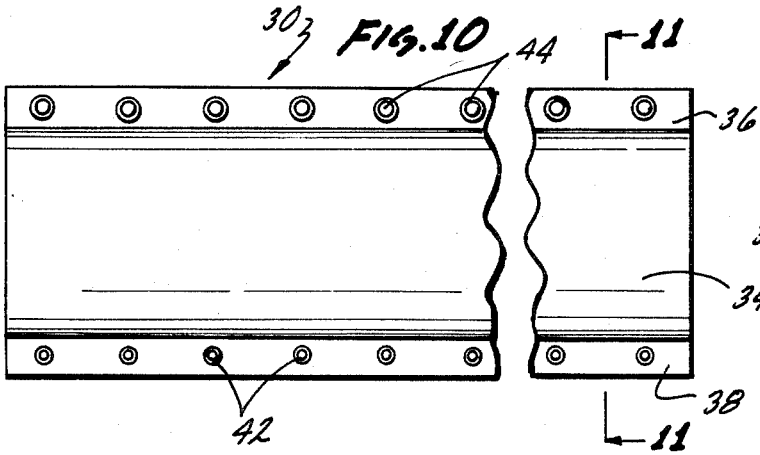
FIG. 10
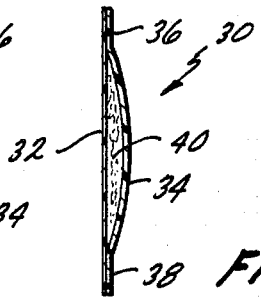
FIG. 11
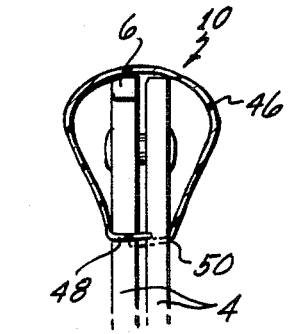
FIG. 12
FIG. 13
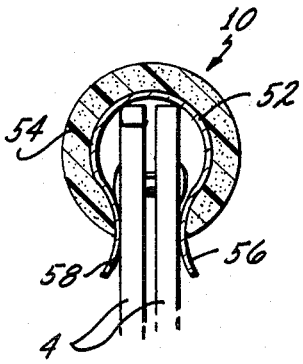
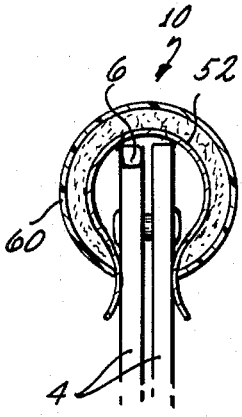
FIG. 14

PROTECTOR FOR LAZY-TONG FENCE

BACKGROUND OF THE INVENTION

The present invention is in the field of safety equipment and more specifically relates to an article for use with lazy-tong fences to prevent children from being injured by the vertices of the fence.

Lazy-tong fences are frequently found in the form of a gate, such as that shown in FIG. 1, which is used to confine young children or to keep them from falling down stairs. The lazy-tong fence mechanism is also found in the form of corrals, such as that shown in FIG. 2, to confine children. The present invention is usable with fences, gates, and corrals that use the lazy-tong structure; the word fence as used below includes gates, fences and corrals.

Although lazy-tong fences are frequently used for confining young children, it is surprising that so little attention has been given to the safety aspects of such fences. Surprisingly, such fences can be hazardous to the children they are intended to protect.

When deployed, the fences are, typically 24 to 31 inches high. The average height of a two-year old child is 34 inches. Thus, the exposed upper vertices of the fence are positioned approximately at the eye level of the child. It is well known, that children sometimes become restless when confined, and this restlessness may manifest itself in attempts to climb up the fence or to engage in other active behavior. A child who attempts to climb the fence may fall and be injured by the vertices of the fence. The present invention is based on the premise that such fences are hazardous and should be made less hazardous by the use of protectors such as those described below.

U.S. Pat. No. 1,711,394 to Moore is exemplary of a large body of patents that show lazy-tong fences. None of these patents suggests protection from injury. On the contrary, many of the patents relating to lazy-tong fences show spikes or barbs that are designed to injure people who try to climb over the fence.

In U.S. Pat. No. 3,144,236, Clanin shows a protective cover for furniture corners. The covering is held in place by ties. This protector consists only of cushioning material and does not include any rigid material to round out the corners.

In U.S. Pat. No. 3,061,306, Magill shows a resilient extrusion that can be slipped over the top rail of a hurdle to prevent injury. The device grips the top rail of the hurdle. This apparatus is deemed unsatisfactory for use with lazy-tong fences where one is concerned about face and eye injuries, because if the apparatus is made sufficiently stiff to grip the fence, it would be too firm and would injur the face and eyes of a child.

In U.S. Pat. No. 687,649, Pascocello shows a series of rubber fingers that extend up from the framework of a hurdle so as to provide a yieldable upper portion to the fence. This apparatus does not appear to be usable with a lazy-tong fence.

In summary, it appears that little thought has been given to protective devices for use with lazy-tong fences, and existing protective apparatus does not appear to be suitable for such use.

SUMMARY OF THE INVENTION

The present invention includes an article for protecting a child from accidental injurious contact with the upwardly pointed vertices of a lazy-tong fence.

In a first embodiment, the invention includes a pocket-shaped shell of a material that is not rigid but which is stiff enough to hold its shape. A strap for securing the shell in place over the vertex is included as part of the article. The shell functions to replace the corner of the vertex by a surface of larger radius of curvature and by yieldably resisting deformation when struck. See FIGS. 3 and 4.

In another embodiment, the shell of the first embodiment is surrounded by an applied layer of a soft cushioning material. See FIGS. 5 and 6.

In a third embodiment, shown in FIGS. 7 and 8, the soft cushioning layer of the second embodiment is surrounded by an outer shell which, like the inner shell is not rigid and which is bonded to the inner shell to enclose a space in which loose cushioning material may be contained.

The first three embodiments are articles that each cover one of the vertices of the lazy-tong fence. In a second aspect of the present invention, there is described a single protective cushion that covers more than one vertex of the lazy-tong fence. In this aspect of the invention, one embodiment of which is shown in FIGS. 9–11, the protective cushion has the form of an elongated soft pliant pad that is draped over the vertices of the fence and then secured to the fence in that position. This embodiment of the invention is primarily intended for corrals in which the vertices do not lie in a straight line.

The novel features which are believed to be characteristic of the invention, both as to organization and method of operation, together with further objects and advantages thereof, will be better understood from the following description considered in connection with the accompanying drawings in which several preferred embodiments of the invention are illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 relates to the prior art and is a perspective view showing a lazy-tong gate;

FIG. 2 relates to the prior art and is a perspective view showing a lazy-tong fence used as a corral;

FIG. 9 is a side elevation view showing a fourth embodiment of the protector of the present invention;

FIG. 10 is a plan view of the embodiment of FIG. 9;

FIG. 11 is a cross-sectional view of the protector of FIG. 10, viewed in the direction 11—11 indicated in FIG. 10;

FIG. 12 is an end cross-sectional view of a fifth embodiment of the present invention;

FIG. 13 is an end cross-sectional view of a sixth embodiment of the present invention;

FIG. 14 is an end cross-sectional view of a seventh embodiment of the present invention;

FIG. 15 is an end cross-sectional view of another embodiment of the present invention;

FIG. 16 is an end cross-sectional view of another embodiment of the present invention; and, FIG. 17 is an end cross-sectional view of another embodiment of the present invention.

DETAILED DESCRIPTION OF THE PREFERRED EMBODIMENTS

Figure 3:
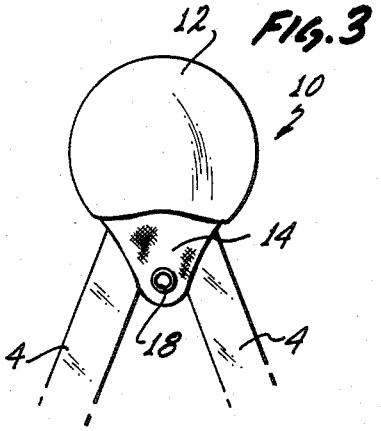
FIG. 3 is a side elevation view showing a first embodiment of a protector in accordance with the present invention.

Turning now to the drawings in which like parts are denoted by the same reference numeral throughout, there is shown in FIG. 1 a lazy-tong fence 2 used as a gate. The lazy-tong fence includes legs of which the legs 4 are typical. At the top of the fence, the legs 4 intersect to form vertices of which the vertices 6 are typical.

FIG. 2 shows another form of lazy-tong fence known in the prior art. In FIG. 2, the fence has been bent to form an enclosure referred to herein as a corral.

The protective apparatus of the present invention is usable with all types of lazy-tong fences, and in additional can be used with many other types of fences.

Figure 4:
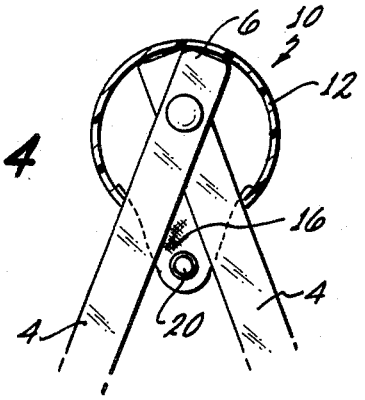
FIG. 4 is a cross-sectional side elevation view of the embodiment of FIG. 3.

FIGS. 3 and 4 show a protective article 10 in accordance with a first preferred embodiment of the present invention. The protective article 10 includes a pocket-shaped shell 12 that slips over the vertex formed by the intersection of the legs 4. The shell 12 is stiff enough to hold its shape, but resilient enough to yield when bumped. In the first preferred embodiment, the shell 12 is made of plastic and is thin enough to attain the desired resiliency. In other variations of this embodiment, the shell 12 is made of a soft rubber.

Straps 14, 16 are connected to the shell 14 on opposite sides of it. The strap 14 includes the female portion 18 of a snap fastener, and the strap 16 includes the male portion 20 of a snap fastener. In FIGS. 3 and 4 the straps 14, 16 are shown hanging loose for purposes of illustration, but in use the parts 18, 20 of the snap fastener are interconnected to secure the shell 12 to the vertex. In this embodiment, the straps 14, 16 are bonded to the shell 12 by a suitable adhesive. In other variations of this first embodiment, the straps 14, 16 are connected to the shell 12 by fasteners or are molded into the plastic.

The shell 12 of the embodiment of FIGS. 3 and 4 has a generally spherical shape, and this presents a much larger radius of curvature than the corners of the legs 4 to a person striking the lazy-tong fence at one of its vertices. For this reason, injury to the person striking the protective shell 12 will be much less severe. Also, the shell 12, as mentioned above, is resilient, and therefore absorbs most of the blow by flexing.

Figure 5:
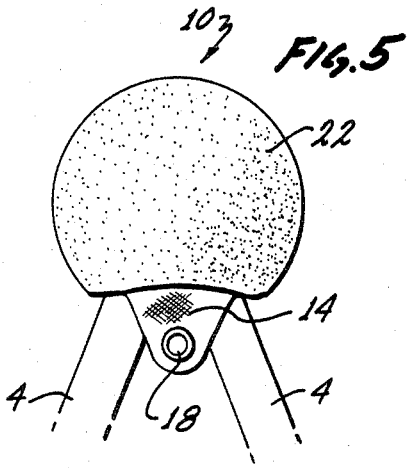
FIG. 5 is a side elevation view showing a second embodiment of the present invention.
Figure 6:
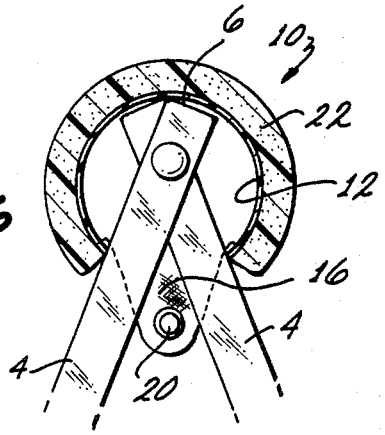
FIG. 6 is a cross-sectional side elevation view of the embodiment of FIG. 5.

FIGS. 5 and 6 show a second perferred embodiment of the present invention. This embodiment is generally similar to the first embodiment except for the addition of a layer 22 of a cushioning material such as plastic foam or foam rubber. This layer 22 not only augments the cushioning, but further increases the radius of curvature of the exposed portions, compared with the embodiment of FIGS. 3 and 4.

Figure 7:
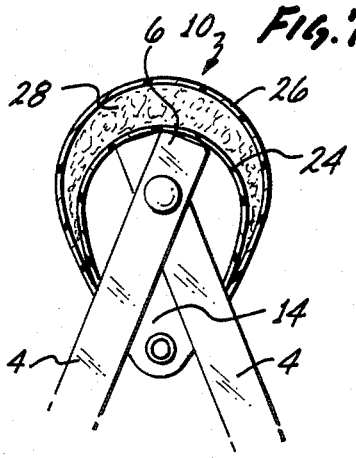
FIG. 7 is a cross-sectional side elevation view of a third embodiment of the present invention.
Figure 8:
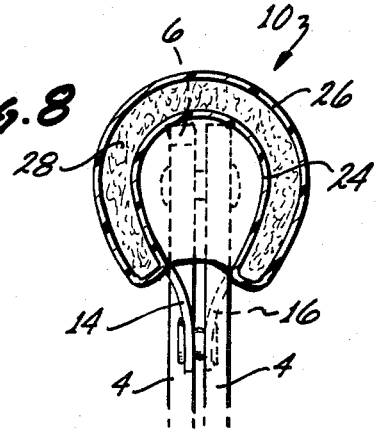
FIG. 8 is a cross-sectional end view of the embodiment of FIG. 7.

FIGS. 7 and 8 show a third perferred embodiment of the protector of the present invention. This embodiment includes an outer shell 26 which surrounds the inner shell 24 but is spaced from the inner shell to enclose a space between the shells that contains a loose cushioning material 28 such as sawdust or shredded plastic foam. In another variation of this embodiment, the space between the inner shell 24 and the outer sheet 26 is filled with a liquid. In still another embodiment, the space contains merely air. The edge of the inner shell is joined to the edge of the outer shell, so that the shells form a unitary structure.

FIGS. 9, 10 and 11 show a fourth preferred embodiment of the invention in which a single protective article covers more than one vertex of the lazy-tong fence. In this embodiment, the protective article assumes the form of an elongated pad 30 that is formed by bonding two sheets 32, 34 of a durable pliable material along their edges 36, 38. The space enclosed between the sheets 32, 34 contains a cushioning material. In this embodiment, the cushioning material 40 is an elongated strip of foamed plastic. In another variation of this embodiment, the cushioning material 40 is a loose material.

Along the edge 38 are spaced a plurality of male snap fastener portions 42, and along the edge 36 a plurality of opposing female snap fastener portions 44 are spaced.

In use, the elongated pad 30 is draped over the vertices of the lazy-tong fence and then the male snap fastener portions 42 are connected to the female snap fastener portions 44 to secure the pad in its proper position. Because the pad of this fourth embodiment of FIGS. 9–11 contains no rigid parts (except the snap fasteners), this embodiment is suitable for use on corrals of the type shown in FIG. 2 as well as on straight fences of the type shown in FIG. 1.

FIGS. 12, 13 and 14 show respectively the fifth, sixth and seventh perferred embodiments of the invention. These embodiments are analogous to the first three embodiments, as can be seen from the similarity in their cross-sections. However, the protective articles of FIGS. 12, 13 and 14 cover more than one vertex of the lazy-tong fence and these embodiments are elongated structures of uniform cross-section. The articles shown in FIGS. 13 and 14 are particularly suitable for fences in which the vertices lie in a single straight line. The protective articles of FIGS. 12, 13 and 14 include elongated parts 46, 52, 54, 60 that have a uniform cross-section; for convenience such parts will be referred to as extrusions.

In the embodiment of FIG. 12, the protective article is an extruded piece of plastic which is thick enough to hold its shape, but thin enough to allow the protective article to be resilient. The extrusion 46 is secured in position covering the successive vertices by the straps 48, 50 which are connected to the edges of the extrusion 46 at spaced opposing positions along its length.

The embodiment of FIG. 13 makes use of an inner extrusion 52 to which a surrounding layer 54 of a cushioning material has been attached. Because of the presence of the layer 54 of cushioning material, the inner extrusion 52 can be more rigid without impairing the shock-absorbing quality of the protective article. The additional rigidity of the inner extrusion 52 permits the protective article of this embodiment to be clipped over the lazy-tong fence by spreading apart the edges 56, 58 of the inner extrusion. Before the inner extrusion 52 is applied to the lazy-tong fence, the spacing between the edges 56, 58 is less than the thickness of the fence. As the protective article is pushed down over the vertices of the fence, the edges 56, 58 are spread apart by the fence, and the elastic restoring forces in the inner extrusion 52 cause the edges 56, 58 to grip the fence so that the protective article is secured to the fence by friction. Thus, in the embodiment of FIG. 13 it is not necessary to use straps to hold the protective article in place on the fence.

A seventh perferred embodiment of the present invention is shown in FIG. 14. In this embodiment the inner extrusion 52 is identical with that of FIG. 13, but instead of being surrounded by a layer of cushioning material, the inner extrusion 52 of FIG. 14 is surrounded but spaced from an outer extrusion 60. The outer extrusion 60 is more resilient than the relatively rigid inner extrusion 52 to provide the desired cushioning effect. The edges of the outer extrusion 60 are bonded to the inner extrusion 52.

There are numerous ways to secure the protective article 10 to the lazy-tong fence. Some of these ways have already been shown above; for example, the integral straps 14, 16 of FIGS. 3–8, the snap fasteners 42, 44 of FIGS. 9–11, and the clip-like inner extrusion 52 of FIG. 13.

It is also recognized that the protective articles of FIGS. 4, 6, 8, 12, 13 and 14 could be attached to the fence by means of a tab 62 integral with the shell 12 and including a hole through which the hinge pin 64 passes, as shown in FIG. 15.

The techniques and structures described so far for securing the protective article 10 to the lazy-tong fence make use of parts that are integral to the protective article. However, the protective article can also be secured to the lazy-tong fence by the use of separate means. For example, in the embodiment of FIG. 16 a separate split ring 66 of a rigid but flexible material such as plastic is pulled open to slip over the protective article 10 and the elastic restoring forces in the ring 66 hold the protective article 10 in place. In the embodiment of FIG. 17, a separate belt 68 is brought around the protective article 10 encircling it and securing it to the fence. The belt 68 is prevented from coming loose by the buckle 70.

It is recognized that there are many types of fasteners that can be used to interconnect the straps by which the protective article is attached to the fence. In addition to the snap fasteners mentioned above, buckles or VELCRO® fasteners may be used, for example. It is also recognized that the protective article could be nailed or stapled to the legs of the fence.

It is believed that the present invention will greatly remedy the hazard posed by the vertices of a lazy-tong fence. The protective article of the present invention is simple and easy to use. The user deploys the lazy-tong fence to the desired configuration and secures the fence in this chosen configuration. Thereafter, the user covers the vertices with the protective article or articles and then secures the protective article or articles to the fence.

The foregoing detailed description is illustrative of several embodiments of the invention, and it is to be understood that additional embodiments thereof will be obvious to those skilled in the art. The embodiments described herein together with those additional embodiments are considered to be within the scope of the invention.

What is claimed is:

1. An article for protecting a child from accidental injurious contact with an upwardly pointing vertex formed by two legs of a lazy-tong fence, comprising in combination:

(a) pocket-shaped means resilient enough to yield when bumped and to return to its original shape after being bumped and shaped to fit loosely over and to cover the vertex of the lazy-tong fence; and, (b) attaching means connected to said pocket-shaped means and extending between the legs of said lazy-tong fence below the vertex for securing said pocket-shaped means onto the vertex.

2. The article of claim 1 further comprising in combination:

cushioning means surrounding and attached to said pocket shaped means for softening the impact when the child bumps against the article.

3. The article of claim 2 wherein said cushioning means further includes a layer of foamed plastic.

4. The article of claim 1 further comprising in combination:

outer shell means enveloping said pocket shaped means and having an edge joined to said pocket shaped means but otherwise spaced from said pocket shaped means.

5. The article of claim 1 wherein said attaching means further comprise a tab integral with said pocket shaped means and extending from the inside of said pocket shaped means.

6. An article for safely confining a child to a play area, comprising in combination:

a lazy-tong fence having two legs that converge to an upwardly pointing vertex; and, a protective cushion that includes pocket-shaped means resilient enough to yield when bumped and to return to its original shape after being bumped and shaped to fit loosely over and to cover the vertex, and that further includes attaching means connected to said pocket-shaped means and extending between the legs of said lazy-tong fence below the vertex for securing said pocket-shaped means onto the vertex.

7. A method of protecting a child from accidental injurious contact with the upwardly pointing vertices of a lazy-tong fence, comprising the steps of:

(a) deploying the lazy-tong fence;

(b) securing the lazy-tong fence in its deployed configuration;

(c) covering a vertex of the lazy-tong fence with its own separate protective cushion; and, (d) securing the protective cushion to the lazy-tong fence.

8. An article for safely confining a child to a play area, comprising in combination:

a lazy-tong fence having legs that converge to an upwardly pointing vertex; and, a pliable pad that includes an elongated pliant sheet of a durable material long enough to cover several vertices of said lazy-tong fence when said sheet is draped over said several vertices and further including attaching means connected to said sheet and adapted to extend below said vertices for securing said sheet to said lazy-tong fence.

9. A method of protecting a child from accidental injurious contact with the upwardly pointing vertices of a lazy-tong fence, comprising the steps of:

(a) deploying the lazy-tong fence;

(b) securing the lazy-tong fence in its deployed configuration;

(c) draping a protective pad over the vertices; and, (d) securing the protective pad to the lazy-tong fence.

10. An article for protecting a child from accidental injurious contact with the upwardly pointing vertices formed by the legs of a lazy-tong fence, comprising:

a first elongated pliant sheet of a durable material long enough to cover several vertices of the lazy-tong fence when said first elongated pliant sheet is draped over said several vertices;

a second elongated pliant sheet of a durable material of substantially the same size and shape as said first elongated pliant sheet and joined at its longer edges to said first elongated pliant sheet but otherwise generally spaced from said first elongated sheet; and, cushioning material located in the space between said elongated pliant sheet and said second elongated pliant sheet.

11. The article of claim 10 further comprising:

attaching means extending between the legs of said lazy-tong fence below the vertices for securing said article to the lazy-tong fence.

12. An article for protecting a child from accidental injurious contact with the upwardly pointing vertices formed by the legs of a lazy-tong fence, comprising:

a first elongated pliant sheet of a durable material long enough to cover several vertices of the lazy-tong fence when said first elongated pliant sheet is draped over said several vertices;

a second elongated pliant sheet of a durable material of substantially the same size and shape as said first elongated pliant sheet and joined at its longer edges to said first elongated pliant sheet but otherwise generally spaced from said first elongated sheet;

cushioning material located in the space between said elongated pliant sheet and said second elongated pliant sheet; and, attaching means extending between the legs of said lazy-tong fence below the vertices for securing said article to the lazy-tong fence.

* * * * *